US008811650B2

(12) United States Patent
Servadio

(10) Patent No.: US 8,811,650 B2
(45) Date of Patent: Aug. 19, 2014

(54) RIBBON TRANSDUCER PROVIDED WITH DYNAMIC TENSIONING SYSTEM

(75) Inventor: Maurizio Servadio, Monte San Vito (IT)

(73) Assignee: Ask Industries Societa' per Azioni, Monte san Vito (IT)

( * ) Notice: Subject to any disclaimer, the term of this patent is extended or adjusted under 35 U.S.C. 154(b) by 0 days.

(21) Appl. No.: 13/411,156

(22) Filed: Mar. 2, 2012

(65) Prior Publication Data

US 2012/0224727 A1 Sep. 6, 2012

(30) Foreign Application Priority Data

Mar. 3, 2011 (IT) ..... AN2011A0030

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |

(52) U.S. Cl.

USPC ..... 381/399; 381/176; 381/398; 381/433

(58) Field of Classification Search

CPC ..... H04R 7/04; H04R 7/16; H04R 7/18; H04R 7/20; H04R 7/22; H04R 31/003; H04R 31/006; H04R 2307/027; H04R 2307/201; H04R 2307/204; H04R 2307/207; H04R 9/06; H04R 9/045; H04R 9/048

USPC ..... 381/176, 398, 399, 408, 427, 431, 433; 181/166, 168, 170–173

See application file for complete search history.

(56) References Cited

U.S. PATENT DOCUMENTS

| | | | | |
|---|---|---|---|---|
| 4,461,932 | A | 7/1984 | Oyaba | |
| 5,148,888 | A | 9/1992 | Bank et al. | |
| 2009/0010480 | A1 * | 1/2009 | Ding | 381/395 |
| 2011/0038501 | A1 * | 2/2011 | Akino | 381/355 |

FOREIGN PATENT DOCUMENTS

EP 0404487 A2 12/1990

OTHER PUBLICATIONS

European Search Report dated Aug. 24, 2011.

* cited by examiner

*Primary Examiner* — Duc Nguyen

(74) *Attorney, Agent, or Firm* — Lowe Hauptman & Ham, LLP

(57) ABSTRACT

A ribbon transducer comprising a ribbon made of conductive material, two rigid supports where the ends of the ribbon are fixed, and a tensioning and damping system provided at least at one end of the conductive ribbon to tension the ribbon and damp its movements. The tensioning and damping system comprises a leaf spring comprising a first end section to which said ribbon is fixed and a second end section fixed to said rigid support, in such a way to exert a tensile force in the tensioning direction of the ribbon.

13 Claims, 2 Drawing Sheets

RIBBON TRANSDUCER PROVIDED WITH DYNAMIC TENSIONING SYSTEM

RELATED APPLICATIONS

The present application is based on, and claims priority from, Italian Application Number AN2011A000030, filed Mar. 3, 2011, the disclosure of which is hereby incorporated by reference herein in its entirety.

TECHNICAL FIELD

The present patent application for industrial invention relates to a ribbon transducer, in particular for loudspeakers and microphones, provided with dynamic tensioning system.

BACKGROUND

Generally, ribbon transducers are fixed at the ends to a rigid support, in such manner to be tensioned in order to vibrate and generate an acoustic signal.

However, such types of ribbon transducers have a short life because they tend to tear or loosen during operation, resulting in degraded performance.

Such problems are at least partially solved in the European patent EP 0 404 487 (Celestion), which discloses an elastic damping element shaped as a flat plate that is glued in a section of the ribbon near its end. In any case, both the end of the ribbon and the end of the elastic element are fixed to a rigid support element.

The solution disclosed in EP 0 404 487 is impaired by several drawbacks.

The ribbon cannot be suitably tensioned, otherwise the elastic element would detach from the ribbon; consequently, good performance is impossible to obtain and the tension of the ribbon cannot be set d according to the requirements and type of sound to be obtained.

The ribbon only has one monolateral asymmetric curvature; consequently, the elastic damping element has a limited travel with respect to the constraints and the ribbon may break in case of multi-directional stress, for example orthogonal distractions to the longitudinal axis of the ribbon.

The elastic damping element is flat and not conductive (therefore inactive) and has the same width as the conductive ribbon. Therefore, the elastic damping element introduces an asymmetry, and especially a spurious emission caused by its geometry. In fact, said elastic element can be efficiently coupled with air and can produce a sound that, in such a situation, interferes with the primary source (sound emitted by the ribbon) that should instead be the only source to emit a sound. These types of elastic elements are light and able to vibrate in an anomalous way not related with the main signal.

Such a system is rather complex to assemble because it provides for two anchoring points to the rigid support. In fact, both the end of the ribbon and the end of the elastic element must be fixed to the rigid support. Moreover, damping material must be necessarily inserted in the area where the ribbon is folded in order to decrease mechanical and acoustic interference. Additionally, such an approach requires dynamometric systems in order to calibrate the tensioning of the system.

SUMMARY

The purpose of the present invention is to eliminate the drawbacks of the prior art by devising a ribbon transducer that is reliable, effective, efficacious and simple to make and assemble.

Another purpose of the present invention is to provide a ribbon transducer that may be easily mounted and suitably tensioned, while guaranteeing high sound quality and long life.

Advantageous embodiments appear from the dependent claims.

The ribbon transducer of the invention comprises:

a ribbon made of conductive material, two rigid supports where the ends of the ribbon are fixed, and a tensioning and damping system provided at least at one end of the conductive ribbon to tension the ribbon and damp its movements.

Said tensioning and damping system comprises a leaf spring comprising a first end section to which said ribbon is fixed and a second end section fixed to said rigid support, in such a way to exert a tensile force in the tensioning direction of the ribbon.

Because of the leaf spring, the transducer according to the invention allows for tensioning the ribbon by applying two opposite forces only at the ends of the ribbon, in such manner to give mechanical stability and apparent rigidity to the ribbon that is otherwise impossible to obtain. Such a high tensile force, obviously, is also able to counterbalance important elongations originated from thermal and mechanical stress. The leaf is enormous compared to the excitation force and this allows for completely absorbing the spurious vibration in such section.

The force applied at the ends of the ribbon can be expressed in approximately 10 Kg, but such force depends on the acoustic characteristics to be given to the system (for example, high resonance frequency can be obtained by tensioning the ribbon with a 20 Kg force, in combination with high mechanical damping, whereas if the force is reduced to 2 Kg, for example, a very low resonance and a propensity to reproduce low frequencies are obtained). This is an important issue because it permits a very wide margin of maneuver in choosing the force to be applied to set the acoustic behavior of the transducer according to the specific requirements.

In brief, the transducer of the invention has the following advantages compared to the transducers of the prior art:

the ribbon of the transducer of the invention can be tensioned with important forces such to modify acoustics.

The suspension assembly of the transducer of the invention is acoustically inert, whereas transducers of the prior art have spurious emissions depending on the geometry of the damping system.

The transducer of the invention allows non-expert users to repair severe faults in the simplest way possible, without the need to use special equipment or calibration systems. Moreover, being a total novelty, such a repair operation can be carried out without disassembling the frame from the other structures of the acoustic system.

The transducer of the invention is symmetrical with respect to the constraint of the ribbon, whereas transducers of known type are asymmetrical. As a matter of fact, according to the prior art, the folding systems of the membrane are not suspension systems, but a palliative solution in the attempt to counterbalance the transverse movements of the non-tensioned ribbon.

BRIEF DESCRIPTION OF THE DRAWINGS

Further characteristics of the invention will appear clearer from the detailed description below, which refers to merely illustrative, not limiting, embodiments, illustrated in the attached drawings, wherein.

DETAILED DESCRIPTION

Figure 1:
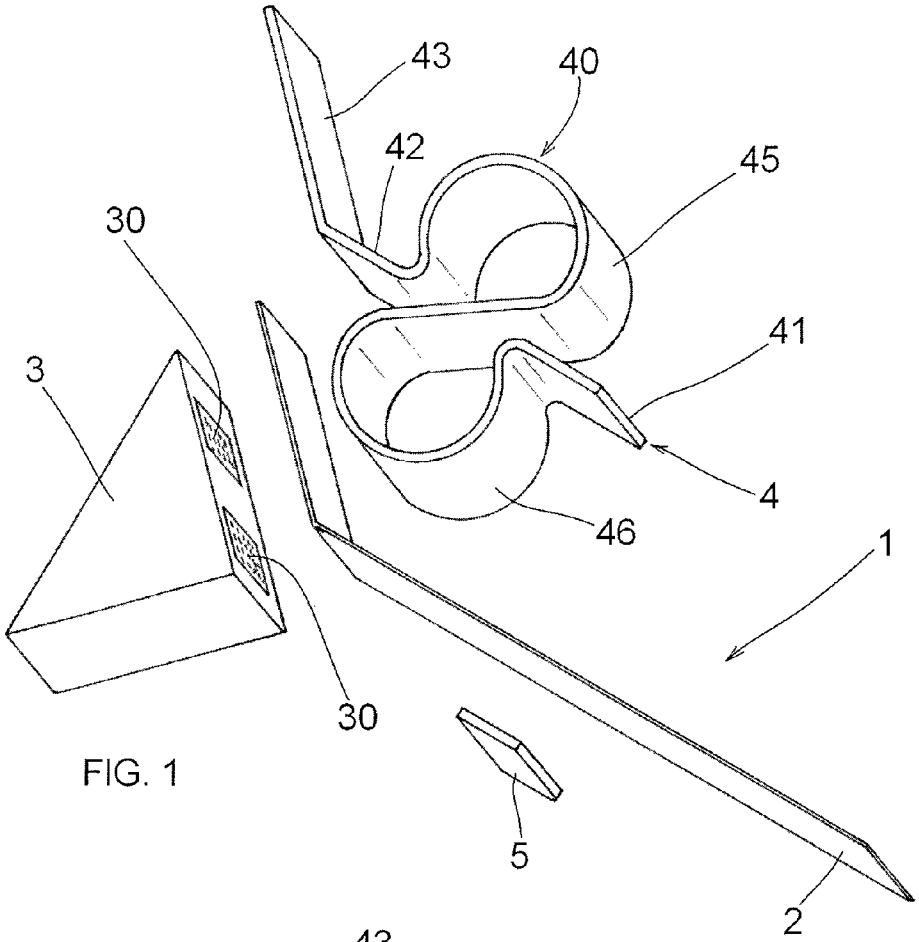
FIG. 1 is an exploded perspective view of a first embodiment of the ribbon transducer of the invention.
Figure 2:
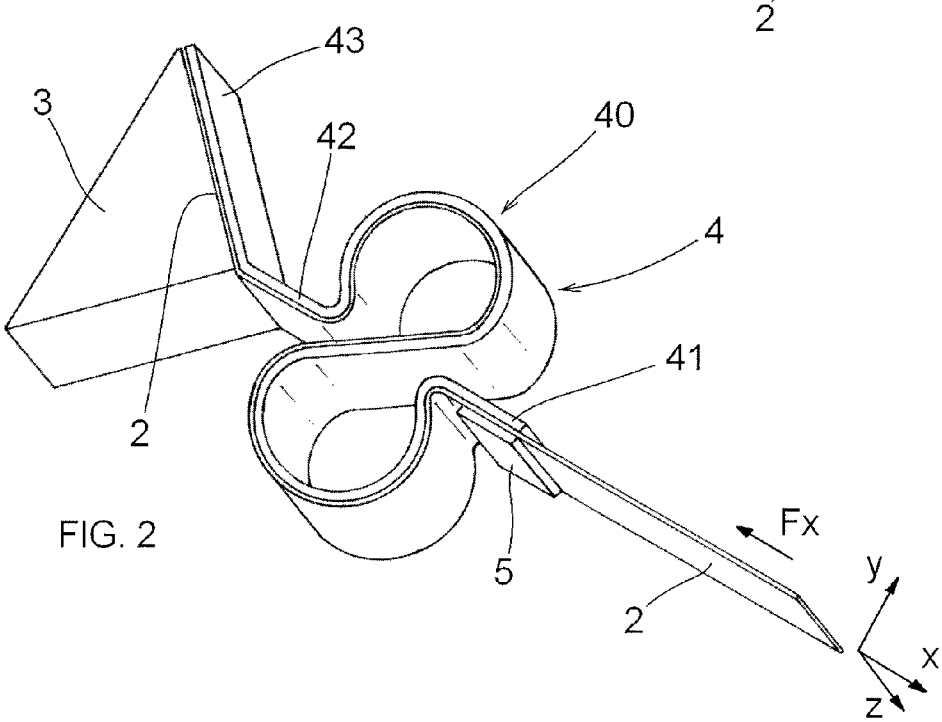
FIG. 2 is a perspective view of the ribbon transducer device of FIG. 1 in assembled condition.
Figure 3:
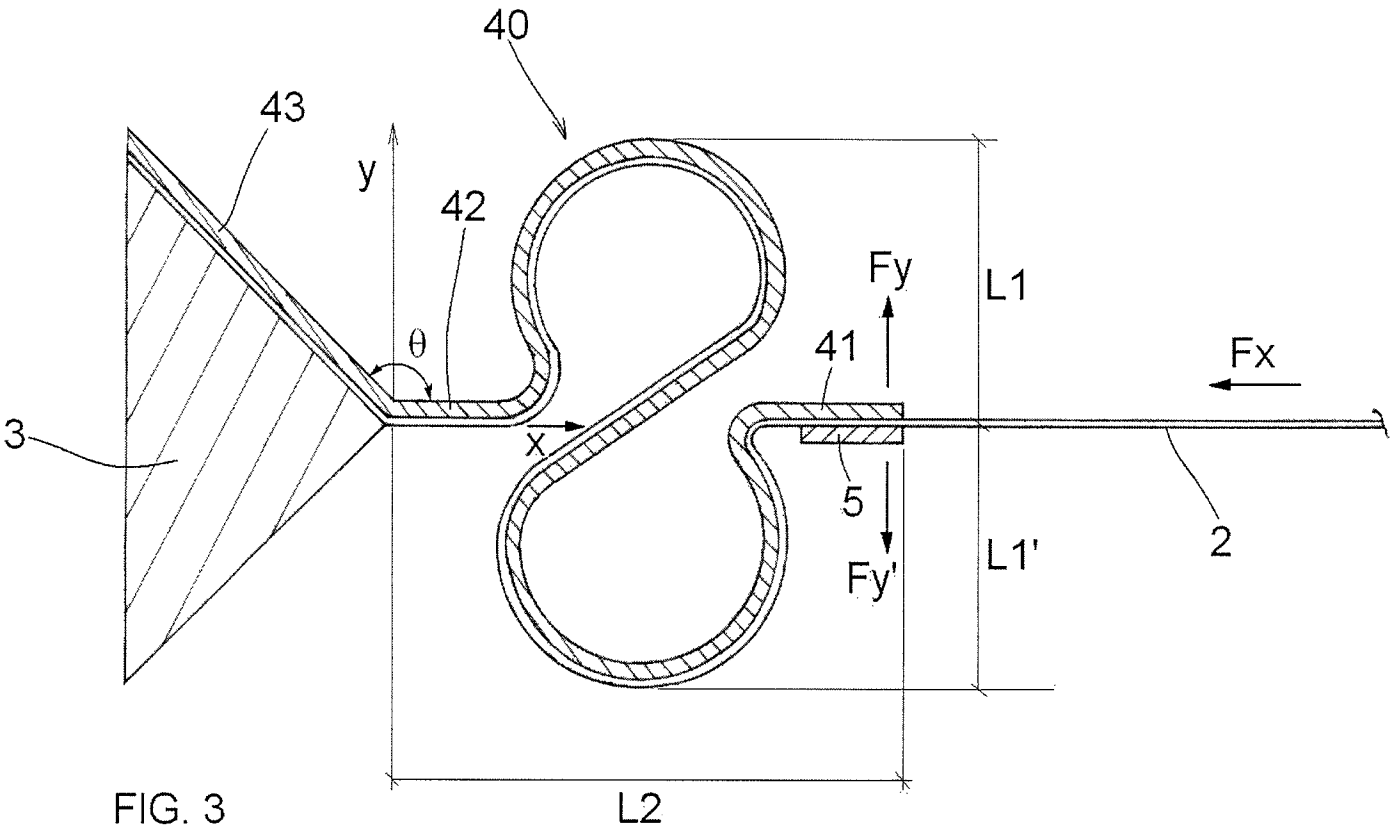
FIG. 3 is a longitudinal sectional view of the ribbon transducer of FIG. 2.

Referring to FIGS. 1 to 3, a first embodiment of the ribbon transducer according to the invention is disclosed, being generally indicated with numeral (1).

The transducer (1) comprises a conductive ribbon (2) made of amagnetic material, such as aluminum, titanium, beryllium or alloys amagnetic materials. The ribbon (2) has low thickness of approximately 0.005 mm in such a way to bend easily.

The two ends of the ribbon (2) are fixed to two rigid supports (3) by means of a tensioning and damping element (4). In the supports (3) electrical contacts (30) are provided and adapted to go in contact with the ends of the conductive ribbon (2). So, when the conductive ribbon (2) is crossed by an electrical signal, it starts vibrating, thus converting the electrical signal into an acoustic signal The tensioning and damping element comprises a leaf spring (4). The leaf spring (4) is composed of a metal strip preferably having equal or higher width than the ribbon (2). However, the width of the leaf spring (4) can be also lower than the width of the ribbon if a suitable configuration of the leaf spring is chosen.

The metal strip of the leaf spring is preferably made of the following metals: titanium, high-resistance magnetic and non-magnetic steels, alloys of aluminum, magnesium, ceramic-loaded plastic materials, carbon, phosphorous bronze, and copper beryllium. The metal strip of the leaf spring has thickness of approximately 0.2 mm and weight hundreds of times higher than the ribbon (2).

The leaf spring can be made of a sandwich of thin leaves (leaf sprint type) and the conductive ribbon can be coupled to the leaves in any position (superficially to first or last or between them).

The leaf spring (4) comprises a curved intermediate section (40) arranged between two flat sections (41, 42). The first flat section (41) is the first end of the leaf spring and is directed in conformity with the plane of the ribbon (2) when it is tensioned. The second flat section (42) continues with a second end portion (43) tilted with respect to the second flat section, for example by an angle (o) of approximately 135° (FIG. 3).

The curved intermediate portion (40) is basically shaped as an S, in such manner that the two ends of the S are joined with the first flat section (41) and second flat section (42). The two flat sections (41, 42) basically lay on the same plane that coincides with the tensioning plane of the ribbon (2).

Although the leaf spring (40) has an S-shape in the figures, it can have different shapes and dimensions in compliance with the symmetry and tensioning principle.

Referring to FIG. 2, three Cartesian axes (x, y, z) with respect to the plane of the tensioned ribbon (2) are identified, wherein:

direction (x) is the longitudinal direction of the ribbon, direction (z) is the transverse direction of the ribbon, and direction (y) is the orthogonal direction to the plane of the tensioned ribbon.

Referring to FIG. 3, the S-shape of the curved section (40) of the leaf spring generates two lobes or two semi-circumferences that identify two short arms extending along direction (y) in opposite directions with respect to the tensioning plane of the ribbon. The length of the upper arm is indicated as (L1) and the length of the lower arm is indicated as (L1'). It must be considered that the leaf spring assembly composed of the curved section (40) and the two flat sections (41, 42) is symmetric. Therefore, the length (L1) of the upper arm is identical to the length (L1') of the lower arm.

Instead, a longitudinal arm with length (L2) extending along direction (x) is defined by the connection point of the second end (43) with the second flat section (42) at the end of the first flat section (41). The longitudinal arm has higher length (L2) than length (L1, L1') of each arm defined by the lobes of the S. The length (L2) of the longitudinal arm is approximately double the length (L1, L1') of each arm defined by the lobes of the S.

Referring to FIGS. 1-3, the leaf spring (4) has upper surface (45) and lower surface (46). The ribbon (2) is arranged on the lower surface (46) of the leaf spring (4) so that it follows the S-shaped curved section (40).

The section of ribbon (2) situated under the first flat section (41) of the leaf spring is fixed to the leaf spring (4) by means of anchoring means (5), is such as a clip made of non-conductive plastic material or adhesive band.

Instead, the section of ribbon (2) situated under the second end section (43) of the leaf spring is arranged on the electrical contacts (30) of the rigid support.

A lock block (not shown in the figures) is applied on the second end section (43) of the leaf spring, in such manner to firmly lock the second end section (43) of the leaf spring on the rigid support (3). So, the end section of the ribbon (2) is compressed in sandwich-configuration between the rigid support (3) and the second end section (43) of the leaf spring.

The tensioning system composed of the leaf spring (4) permits to achieve high static tensioning of ribbon (2) upon assembly. Said tensioning is represented by force (Fx) applied on the ribbon in correspondence of the anchoring means (5) used to fix the ribbon (2) to the spring (4).

Thanks to the two short lever arms (L1, L1') of the two lobes of the spring, the configuration of the leaf spring (4) guarantees low stretchiness and low reaction to movement along direction of axis (y), i.e. direction of forces (Fy and Fy') orthogonal to the tensioning force (Fx).

Moreover, the long lever arm (L1) causes high stretchiness along direction of axis (x), i.e. direction of tensioning force (Fx). So, the leaf spring (40) can be easily loaded in such way to guarantee the desired ribbon tensioning, which can reach values higher than 10 Kg.

Moreover, the leaf spring (4) prevents the ribbon (2) from moving along the two directions of axis (z), because such leaf spring is adapted to be rigid and therefore its stretchiness along direction of axis (z) is null, thus preventing the possibility of intercepting lateral elements during motion.

Additionally, the leaf spring (40) can counterbalance the thermal elongation of the flexible ribbon (2) caused by heating during operation.

The symmetry of the leaf spring (4) permits identical reaction forces FKy and FKy' in the two different oscillation directions of the ribbon (2).

The section of ribbon joined with the leaf spring (4) is acoustically dampened and suppressed because of the weight of the leaf spring that, being hundreds of times higher than the weight of the ribbon, prevents the spurious movements of the ribbon, without the need of additional damping elements.

The rigid element (3) determines the elastic reaction point of the leaf spring, precisely in correspondence of the electrical contacts (30).

The end section of the leaf spring rigidly transfers the tensioning force (Fx) generated by the leaf spring to the functional point obtained with the anchoring means (5). Such a rigid transfer function of the tensioning force (Fx) is actuated by the end section (41) of the spring. Since the end section (41) is directed along the traction direction, it has no elastic properties and acts as rigid anchoring base for the ribbon. However, the end section (41) is supported by the long longitudinal arm (L2) and by the two short orthogonal arms (L1 and L1') and can therefore move along two directions: longitudinal direction (x) and orthogonal direction (y) with different stretchiness.

The leaf spring (4) has elastic properties according to the imparted deformation, in such manner to obtain different stretchiness for different work directions. This would be impossible for elements characterized by their own elasticity that would never permit such tensioning forces because of the early yield of elastic materials that, additionally, do not allow realizing systems with differentiated stretchiness according to the stress direction.

Numerous variations and modifications can be made to the present embodiments of the invention, within the reach of an expert of the field, while still falling within the scope of the invention as described in the enclosed claims.

The invention claimed is:

1. A ribbon transducer comprising:

a ribbon made of conductive material;

two rigid supports where ends of the ribbon are fixed;

a tensioning and damping system provided at least at one end of the conductive ribbon to tension the ribbon in a tensioning direction and damp movements of the ribbon; and an anchoring member, wherein said tensioning and damping system comprises a leaf spring comprising a first end section, wherein said ribbon is fixed to the first end section with the anchoring member, and a second end section fixed to said rigid support, in such a way to exert a tensile force greater than 10 kg in the tensioning direction of the ribbon, and the leaf spring is composed of a metal strip.

2. Ribbon transducer as claimed in claim 1, said leaf spring being provided with a curved intermediate section situated between said first end section and said second end section.

3. Ribbon transducer as claimed in claim 2, said curved intermediate section of the leaf spring being arranged between two flat sections of the leaf spring laying on the same plane.

4. Ribbon transducer as claimed in claim 3, wherein said curved intermediate section of the leaf spring is S-shaped, wherein ends of the S-shaped intermediate section are joined with said two flat sections of the leaf spring, in such a way to define two lobes of the S, and wherein each lobe of the S-shaped intermediate section is an arm of the leaf spring that extends orthogonally to said flat sections.

5. Ribbon transducer as claimed in claim 4, wherein said leaf spring protrudes from said rigid support in a longitudinal direction to form a longitudinal arm with a length greater than that of one of the arms of the S-shaped intermediate section.

6. Ribbon transducer as claimed in claim 5, wherein the length of said longitudinal arm of the leaf spring is approximately double the length of said one of the arms of the S-shaped intermediate section.

7. Ribbon transducer as claimed in claim 3, wherein said two flat sections of the leaf spring comprise a first flat section representing the first end section of the leaf spring and a second flat section connected to said second end section of the spring, wherein said second end section is tilted by an angle of approximately 135° with respect to said second flat section.

8. Ribbon transducer as claimed in claim 1, wherein said leaf spring has a thickness of approximately 0.5 mm.

9. Ribbon transducer as claimed in claim 1, wherein the metal strip of said leaf spring is made of the following metals: titanium, high-resistance steels, alloys of aluminum, magnesium, ceramic-loaded plastic materials, carbon, phosphorous bronze, and copper beryllium.

10. Ribbon transducer as claimed in claim 1, wherein said anchoring member comprises at least one of a clip or an adhesive band.

11. Ribbon transducer as claimed in claim 1, wherein said anchoring member anchors said ribbon only to said first end of said leaf spring.

12. Ribbon transducer as claimed in claim 2, wherein said curved intermediate section of the leaf spring is free of fixation to the ribbon.

13. A ribbon transducer comprising:

a ribbon made of conductive material;

two rigid supports where ends of the ribbon are fixed;

a tensioning and damping system provided at least at one end of the conductive ribbon to tension the ribbon in a tensioning direction and damp movements of the ribbon; and an anchoring member, wherein said tensioning and damping system comprises a leaf spring comprising a first end section to which said ribbon is fixed and a second end section fixed to said rigid support, in such a way to exert a tensile force in the tensioning direction of the ribbon, the leaf spring is composed of a metal strip, and said anchoring member anchors said ribbon only to said first end of said leaf spring.

* * * * *